US010994956B2

(12) United States Patent
Nakamura

(10) Patent No.: US 10,994,956 B2
(45) Date of Patent: May 4, 2021

(54) IMAGE FORMING APPARATUS TO ENSURE WORKABILITY IN REMOVING A SHEET IN A CONVEYANCE PATH

(71) Applicant: CANON KABUSHIKI KAISHA, Tokyo (JP)

(72) Inventor: Jun Nakamura, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/850,573

(22) Filed: Apr. 16, 2020

(65) Prior Publication Data

US 2020/0354179 A1 Nov. 12, 2020

(30) Foreign Application Priority Data

May 11, 2019 (JP) ..... JP2019-090269

(51) Int. Cl.
*B65H 5/06* (2006.01)
*G03G 21/16* (2006.01)
*G03G 15/08* (2006.01)

(52) U.S. Cl.
CPC ..... *B65H 5/06* (2013.01); *G03G 15/0887* (2013.01); *G03G 21/16* (2013.01)

(58) Field of Classification Search
CPC ..... B65H 5/06; G03G 21/16; G03G 15/0887
See application file for complete search history.

(56) References Cited

U.S. PATENT DOCUMENTS

2008/0205953 A1* 8/2008 Takemoto ..... G03G 21/1633 399/397
2009/0121416 A1* 5/2009 Tashiro ..... B65H 5/38 271/225
2009/0243199 A1* 10/2009 Daigo ..... B65H 29/58 271/225
2009/0267291 A1* 10/2009 Tabata ..... G03G 15/5029 271/225
2010/0310262 A1* 12/2010 Nanayama ..... G03G 15/234 399/23
2016/0288534 A1* 10/2016 Hirata ..... B41J 11/007
2017/0242368 A1* 8/2017 Nohara ..... H04N 1/04

FOREIGN PATENT DOCUMENTS

JP 2005-115218 A 4/2005

* cited by examiner

*Primary Examiner* — G. M. A Hyder
(74) *Attorney, Agent, or Firm* — Canon U.S.A., Inc. I.P. Division

(57) ABSTRACT

An image forming apparatus includes an image forming unit, an apparatus main body, a conveyance unit, an opening/closing member, a discharge unit, and a stack tray. The conveyance unit conveys a sheet to the image forming unit. The opening/closing member opens and closes relative to the apparatus main body, and, where the opening/closing member is in an open state relative to the apparatus main body, allow making access to the conveyance unit. The discharge unit discharges the sheet on which the image is formed. The stack tray is turned between a first position for stacking sheets on the stack face, and a second position with an angle formed between an underside opposite to the stack face and a horizontal plane that is larger than an angle of the first position, and includes an engagement portion to engage with the apparatus main body in the second position.

5 Claims, 8 Drawing Sheets

IMAGE FORMING APPARATUS TO ENSURE WORKABILITY IN REMOVING A SHEET IN A CONVEYANCE PATH

BACKGROUND

Field

The present disclosure relates to an image forming apparatus such as a copying machine, a printer, a facsimile, or a multifunction peripheral having these functions.

Description of the Related Art

Conventionally, in a case where an error occurs during conveyance of a sheet in a conveyance path of an image forming apparatus, the image forming apparatus stops the conveyance of the sheet and image forming operation, and issues to an operator a notification prompting to remove the sheet in the conveyance path. The operator can restart the image forming operation by removing the sheet in the conveyance path based on such a notification. Therefore, it is desirable to provide the image forming apparatus with a configuration that enables the operator to easily perform work for removing the sheet in the conveyance path.

Japanese Patent Application Laid-Open No. 2005-115218 discusses a related configuration. In the configuration, in order to enable the operator to easily perform work for removing a sheet in a conveyance path, an opening/closing member turnable relative to an apparatus main body is provided so that the conveyance path is easily viewed by opening up the opening/closing member. The operator can easily remove the sheet by opening up the opening/closing member.

In recent years, a method of discharging a sheet having an image formed thereon has been diversified, and there is a case where a plurality of discharge trays is provided in an image forming apparatus in order to change a sheet discharge destination depending on applications such as copy, print, and facsimile. In such a case, a stack tray for stacking discharged sheets may be disposed at a position higher than the above-described conveyance path in a vertical direction.

However, in a case where the stack tray is disposed at the position higher than the conveyance path in the vertical direction as described above in an image forming apparatus discussed in Japanese Patent Application Laid-Open No. 2005-115218 that includes the opening/closing member turnable relative to the apparatus main body to enable the conveyance path to be easily viewed when opened, a space opened by turning the opening/closing member is covered by the stack tray. Therefore, there is a possibility that workability in removing a sheet in the conveyance path may deteriorate even if the opening/closing member is turned.

SUMMARY

The present disclosure is directed to suppressing deterioration of workability when removing a sheet in a conveyance path even in a case where a stack tray is disposed above the conveyance path in a vertical direction.

According to an aspect of the present disclosure, an image forming apparatus includes an image forming unit configured to form an image on a sheet, an apparatus main body containing the image forming unit, a conveyance unit configured to convey a sheet to the image forming unit, an opening/closing member configured to open and close relative to the apparatus main body, and, in a case where the opening/closing member is in an open state relative to the apparatus main body, allow making access to the conveyance unit, a discharge unit disposed above the opening/closing member in a vertical direction and configured to discharge the sheet on which the image is formed by the image forming unit, and a stack tray disposed above the opening/closing member in the vertical direction and including a stack face on which sheets discharged by the discharge unit are stacked, wherein the stack tray is configured to be turned between a first position for stacking sheets on the stack face, and a second position with an angle formed between an underside opposite to the stack face and a horizontal plane that is larger than an angle of the first position, and includes an engagement portion to engage with the apparatus main body in the second position.

Further features of the present disclosure will become apparent from the following description of exemplary embodiments with reference to the attached drawings.

DESCRIPTION OF THE EMBODIMENTS

Exemplary embodiments of the present disclosure will be described below with reference to the drawings. The sizes, materials, shapes, and relative arrangements of components described below are not intended to limit the scope of the present disclosure to those examples unless otherwise specified.

Figure 1:
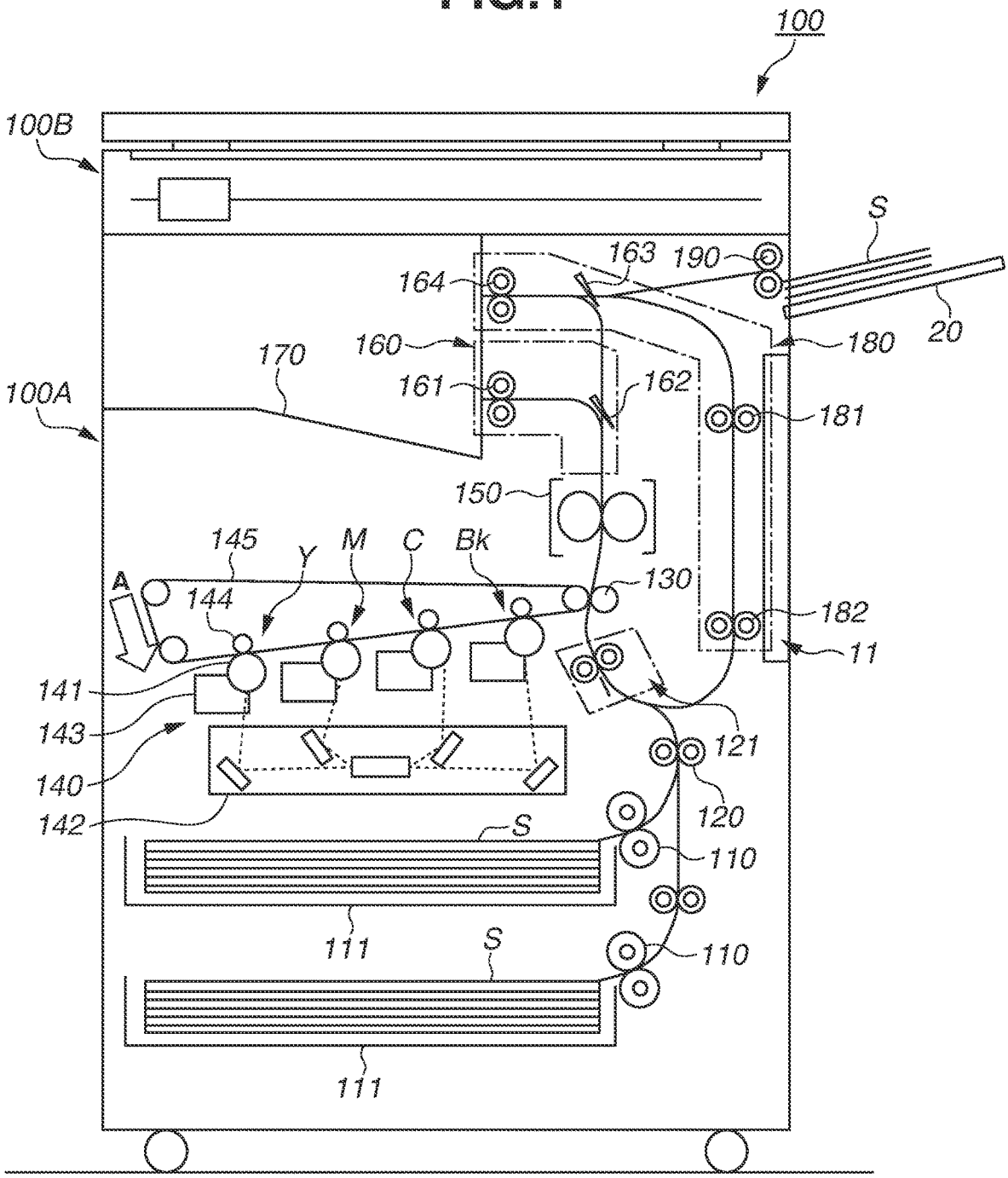
FIG. 1 is a schematic cross-sectional diagram illustrating an image forming apparatus.

A first exemplary embodiment will be described below. FIG. 1 is a schematic cross-sectional diagram illustrating an image forming apparatus 100 in the present exemplary embodiment. The image forming apparatus 100 in the present exemplary embodiment is a multifunctional peripheral and includes an apparatus main body 100A that forms an image on a sheet, and a reader 100B that reads an image of an original document.

The apparatus main body 100A can form an image on a sheet using an image forming unit described below. The apparatus main body 100A controls an image forming unit 140 performed by a control unit (not illustrated) to form the image on a sheet, based on image information transmitted from an external apparatus such as a personal computer (PC) via an external interface, or image information read by the reader 100B.

Here, the image forming unit 140 includes a photosensitive member 141, a laser scanner unit 142, a development device 143, and a primary transfer device 144. The laser scanner unit 142 scans the photosensitive member 141 charged by a charger (not illustrated) using a laser beam, and forms an electrostatic latent image on the photosensitive member 141 based on the scan. The development device 143 develops the electrostatic latent image on the photosensitive member 141 to form a toner image using toner. The primary transfer device 144 transfers the toner image formed by the development device 143 onto an intermediate transfer belt 145.

The control unit (not illustrated) causes the laser scanner unit 142 to emit the laser beam by generating a signal based on the image information, so that the electrostatic latent image is formed on the photosensitive member 141 based on the image information. The development device 143 develops the electrostatic latent image formed on the photosensitive member 141, so that the toner image is formed on the photosensitive member 141.

After that, the primary transfer device 144 applies a predetermined pressing force and an electrostatic load bias, so that the toner image formed on the photosensitive member 141 is transferred onto the intermediate transfer belt 145.

The photosensitive member 141, the development device 143, and the primary transfer device 144 described above are provided for each toner of yellow Y, magenta M, cyan C, and black Bk color, and thus four sets thereof are provided in total.

Next, the intermediate transfer belt 145 will be described. The intermediate transfer belt 145 is driven and conveyed in an arrow-A direction in FIG. 1. An image forming process of each of the Y, M, C, and Bk colors is carried out at the timing of overlaying the corresponding toner image on the upstream toner image transferred onto the intermediate transfer belt 145 by the primary transfer device 144. As a result, a full-color toner image using the toners of the plurality of colors is formed on the intermediate transfer belt 145 and the formed toner image is conveyed to a secondary transfer portion 130.

Meanwhile, print media such as sheets of paper or overhead transparency (OHT) sheets are stacked and contained in a cassette 111 disposed below the image forming unit 140 in a vertical direction, as sheets S. The cassette 111 is disposed such that it can be pulled out in a frontward direction in FIG. 1.

The sheets S stacked and contained in the cassette 111 are separated and fed one by one by a sheet feeding unit 110. The fed sheet S is transferred to a pair of conveyance rollers 120.

The pair of conveyance rollers 120 conveys the sheet S to a skew correction device 121 disposed downstream from the pair of conveyance rollers 120 in a sheet conveyance direction (at an upper part in the vertical direction in FIG. 1), and the skew correction device 121 corrects skew of the sheet S. The sheet S after the skew is corrected is conveyed to the secondary transfer portion 130 along a conveyance path.

The skew correction device 121 temporarily stops the conveyance of the sheet S to correct the skew of the sheet S. In this process, the timing of restarting the conveyance of the sheet S coincides with the timing of conveying the toner image formed on the intermediate transfer belt 145 to the secondary transfer portion 130 to transfer the toner image onto the sheet S.

The sheet S onto which the toner image is transferred is then conveyed to a fixing unit 150. The fixing unit 150 applies to the sheet the predetermined pressing force using a substantially opposing roller or the intermediate transfer belt 145, and a thermal effect produced in general by a heat source such as a heater to melt and fix the toner on the sheet S. The sheet S on which the toner image is thus fixed is directly discharged after the fixing onto a discharge tray 170 by a first discharge roller 161 upon passing through a conveyance unit 160. The discharge tray 170 is disposed in a discharge space formed on the top surface of the apparatus main body 100A and provided below the reader 100B in the vertical direction. Here, the discharge tray 170 is an example of stack trays.

In a case where it is necessary to perform image formation on both sides of the sheet S, a first switching member 162 is switched over to convey the sheet S to a reverse roller 164. Subsequently, the sheet S is conveyed by the reverse roller 164 a predetermined distance to the downstream side in a sheet discharging direction, and then a second switching member 163 is switched over by the reverse rotation of the reverse roller 164, so that the sheet S is conveyed to a reverse conveyance unit 180. Afterward, the sheet S is conveyed by a pair of first reverse conveyance rollers 181 and a pair of second reverse conveyance rollers 182 to arrive at the skew correction device 121 again. The sheet S in the reversed state is then conveyed to the secondary transfer portion 130, so that after an image is formed on a first side, an image is formed on a second side opposite to the first side. In other words, the image is formed on both sides of the sheet. Here, the first switching member 162 and the second switching member 163 are an example of a switching unit.

In a case where the sheet S is to be discharged onto a stack tray 20, the sheet S conveyed by the reverse roller 164 in the reverse direction is conveyed to a second discharge roller 190 by switching over the second switching member 163, and then discharged onto the stack tray 20 by the second discharge roller 190. The second discharge roller 190 is an example of a discharge unit configured to discharge the sheet onto a stack tray.

In the present exemplary embodiment, only the discharge tray 170 is disposed in an inner discharge space provided between the apparatus main body 100A and the reader 100B in the vertical direction. However, a plurality of discharge trays may be disposed in the inner discharge space.

In the image forming apparatus 100 of the present exemplary embodiment, the sheet conveyance operation and the image forming operation within the apparatus main body 100A are stopped in a case where a sheet conveyance error is detected by the control unit (not illustrated). Subsequently, when it is detected by the control unit (not illustrated) that the sheet having the conveyance error or the sheet stopped while conveyed within the apparatus main body 100A has been removed, the image forming apparatus 100 can restart the conveyance operation and the image forming operation in the image forming apparatus 100.

The image forming apparatus 100 of the present exemplary embodiment further includes an opening/closing member 11 that can be opened and closed relative to the apparatus main body 100A. The opening/closing member 11 is opened in a case, for example, where the conveyance of the sheet in the conveyance path of the reverse conveyance unit 180 is stopped for a reason such as occurrence of a conveyance error. FIG. 1 illustrates a state where the opening/closing member 11 is closed. In other words, the figure shows the opening/closing member 11 in a closed position.

Figure 2:
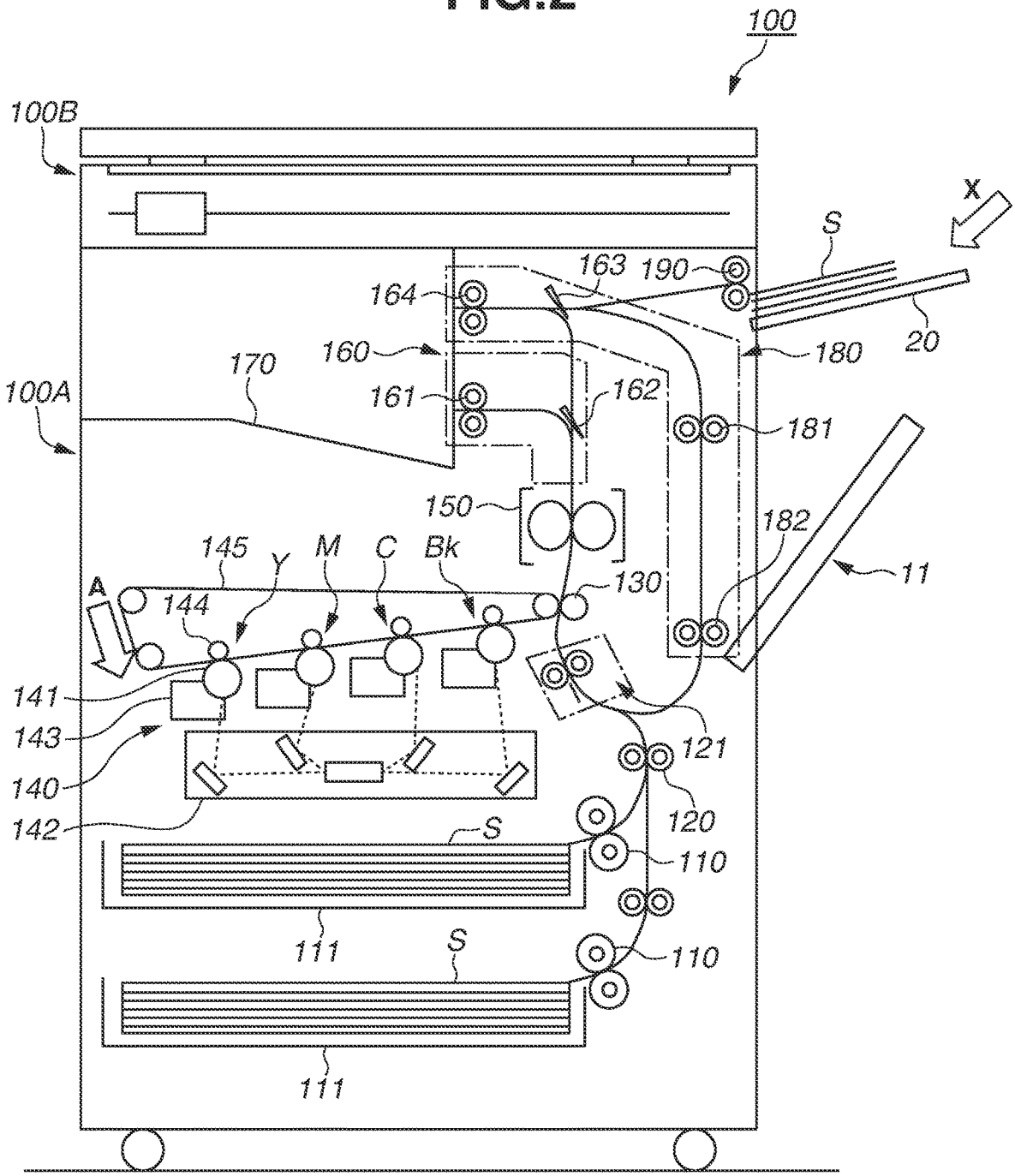
FIG. 2 is a cross-sectional diagram illustrating a state where a conveyance guide unit is in an open state and a stack tray is in a first position.

FIG. 2 is a schematic cross-sectional diagram illustrating an open state where the reverse conveyance unit 180 is opened by turning the opening/closing member 11 relative to the apparatus main body 100A. FIG. 2 shows that the opening/closing member 11 is in an open state, and the stack tray 20 is in a first position for stacking sheets.

In removing the sheet in the reverse conveyance unit 180, the operator can remove the sheet in the reverse conveyance unit 180 by opening the opening/closing member 11. In other words, the opening/closing member 11 allows the operator to make access to the conveyance path of the reverse conveyance unit 180 in a case where the opening/closing member 11 is in the open state relative to the apparatus main body 100A.

In the present exemplary embodiment, the pair of first reverse conveyance rollers 181 and the pair of second reverse conveyance rollers 182 are provided in the apparatus main body 100A.

To be more specific, one of a pair of conveyance guides (not illustrated) that form a part of the conveyance path of the reverse conveyance unit 180, and the pair of first reverse conveyance rollers 181 as well as the pair of second reverse conveyance rollers 182 are provided in the apparatus main body 100A, and the other of the pair of conveyance guides is provided in the opening/closing member 11. Thus, the conveyance guides are opened by opening the opening/closing member 11, so that the conveyance path is exposed, and the sheet in the conveyance path of the reverse conveyance unit 180 can be easily removed.

However, in a state where the stack tray 20 is in the first position for stacking the sheets S discharged by the second discharge roller 190 as illustrated in FIG. 2, it is difficult to view a space of the image forming apparatus 100 opened by turning the opening/closing member 11, from above (e.g., from an arrow-X direction). In this state, it is difficult to make access to the reverse conveyance unit 180 from the arrow-X direction, and workability deteriorates in removing the sheet in the reverse conveyance unit 180.

Further, it is conceivable that, in a case where the stack tray 20 can be turned relative to the apparatus main body 100A, the operator removes the sheet in the conveyance path by opening the opening/closing member 11 while holding the stack tray 20 in the turned state. However, in the configuration, it is necessary for the operator to keep holding the stack tray 20 with one hand, and thus the workability deteriorates in removing the sheet.

Therefore, in the present exemplary embodiment, the stack tray 20 can be held at an angle which can be changed relative to the apparatus main body 100A, so that the workability is improved in removing the sheet. In other words, the stack tray 20 in the present exemplary embodiment can engage with the apparatus main body 100A in a plurality of positions (at least two positions) at different angles.

Figure 3:
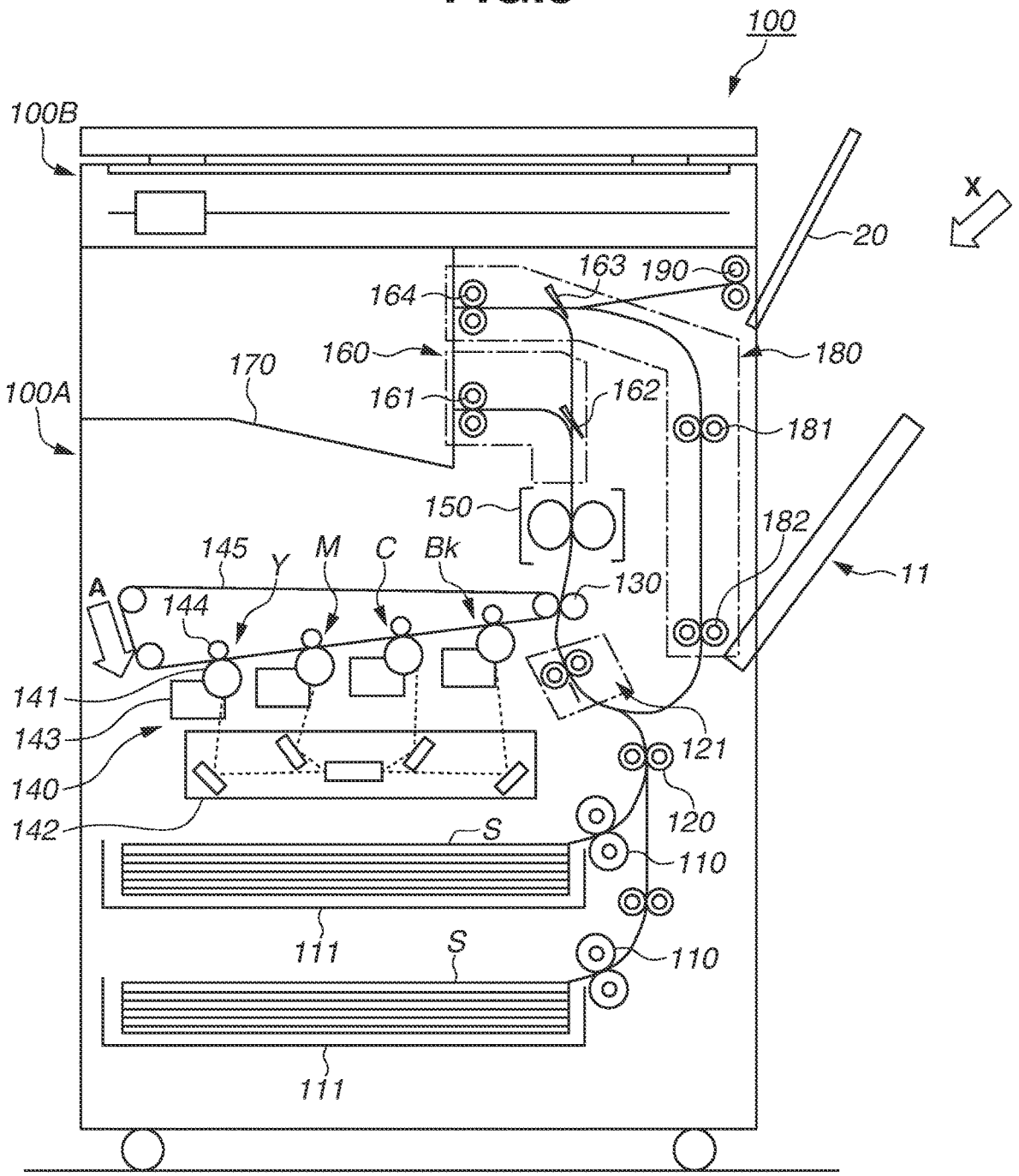
FIG. 3 is a cross-sectional diagram illustrating a state where which the conveyance guide unit is in the open state and the stack tray is in a second position.

FIG. 3 is a schematic cross-sectional diagram illustrating a state in which the reverse conveyance unit 180 is opened by turning the opening/closing member 11 relative to the apparatus main body 100A. In FIG. 3, the opening/closing member 11 is in the open state, and a state where the stack tray 20 is in a second position at an angle sharper than the angle of the first position is illustrated.

The stack tray 20, thus, engages with the apparatus main body 100A at the sharper angle relative to the apparatus main body 100A than the angle at the time of stacking the sheets, so that the visibility of the space opened by turning the opening/closing member 11 from the arrow-X direction can be improved. In addition, because the stack tray 20 can engage with the apparatus main body 100A in the plurality of positions at different angles, it is not necessary for the operator to keep holding the stack tray 20 in removing the sheet, and thus, the workability improves.

FIG. 3 illustrates a configuration in which no sheets are stacked when the stack tray 20 is turned. However, the angle of the stack tray 20 relative to the apparatus main body 100A may be configured to change in a state where the sheets are stacked.

Figure 4B:
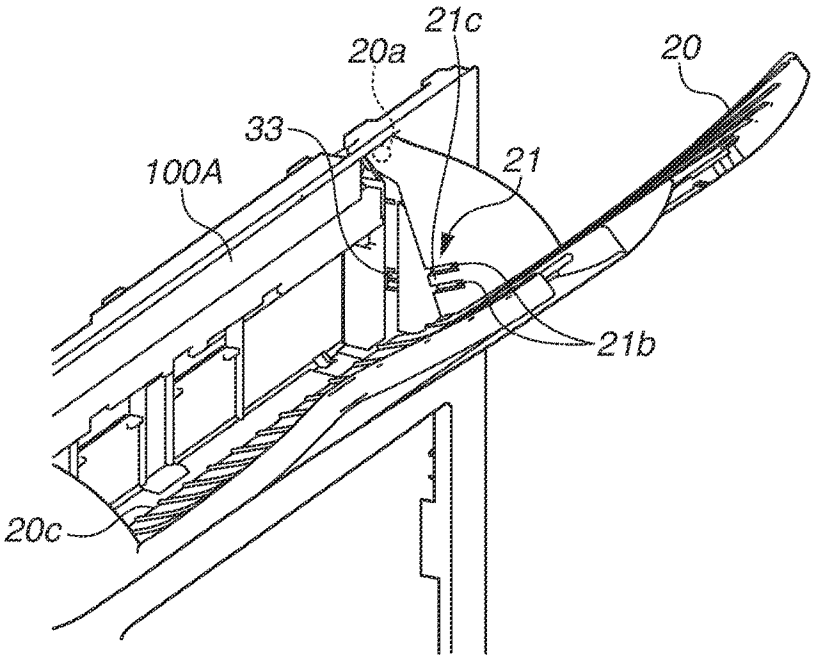
FIGS. 4A and 4B are perspective diagrams each illustrating an engaging state of the stack tray with an apparatus main body.
Figure 4A:
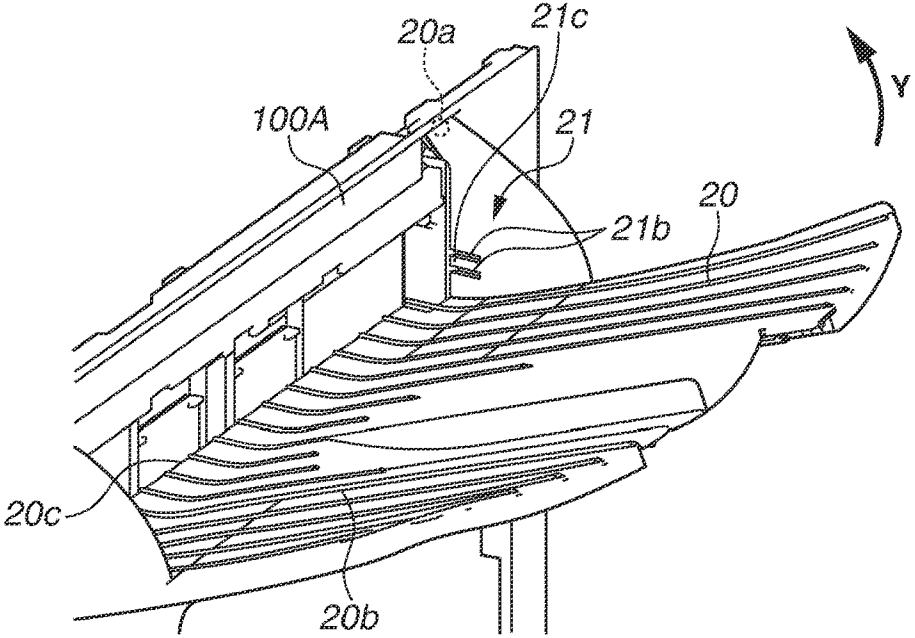
Figure 5:
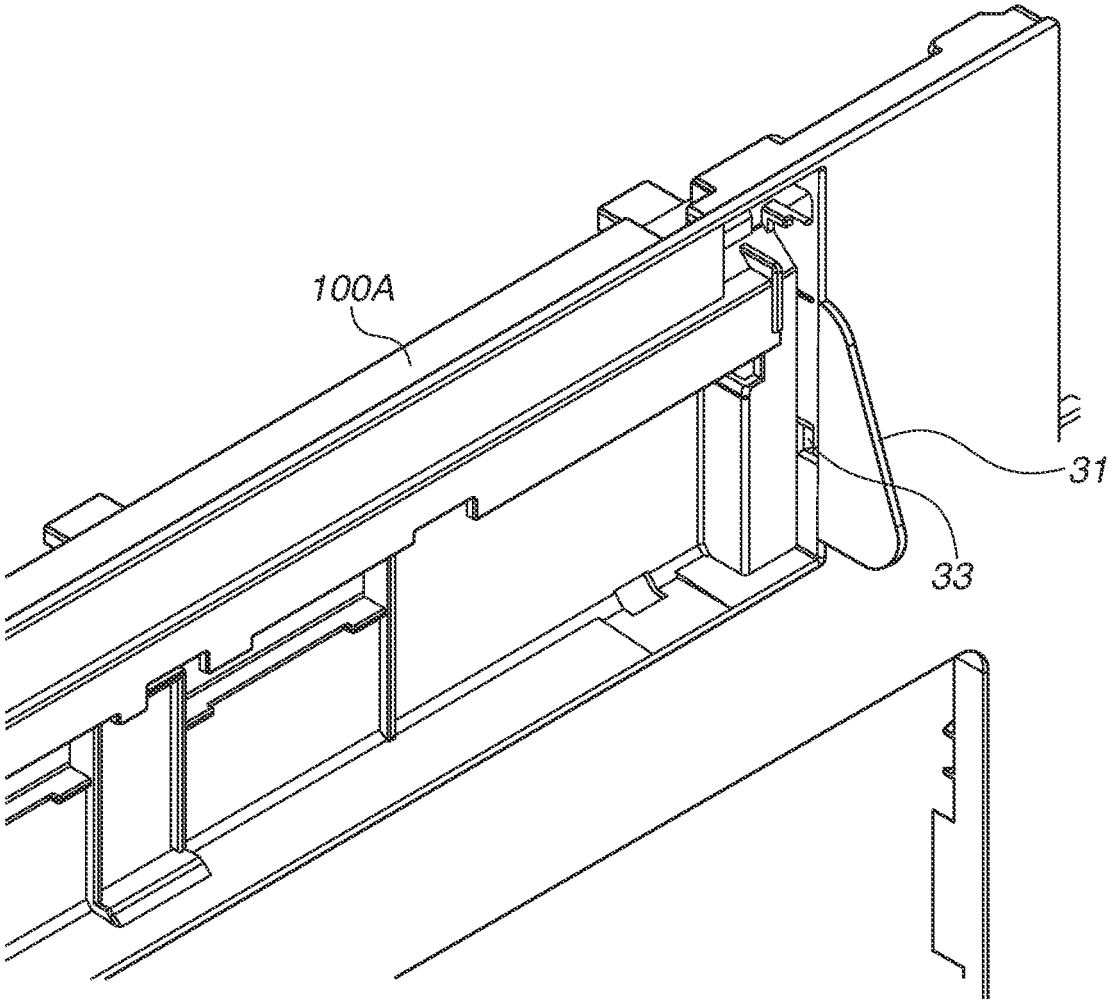
FIG. 5 is a perspective diagram illustrating apart near an engagement portion of the stack tray.
Figure 6B:
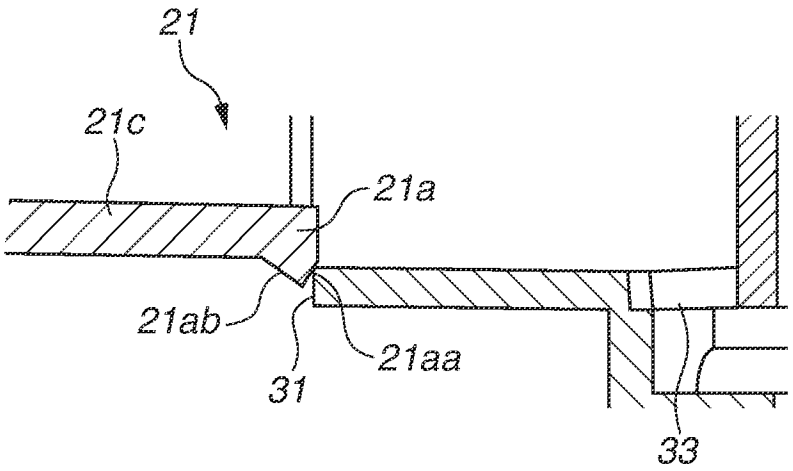
FIGS. 6A and 6B are cross-sectional diagrams illustrating the engaging state of the stack tray with the apparatus main body.
Figure 6A:
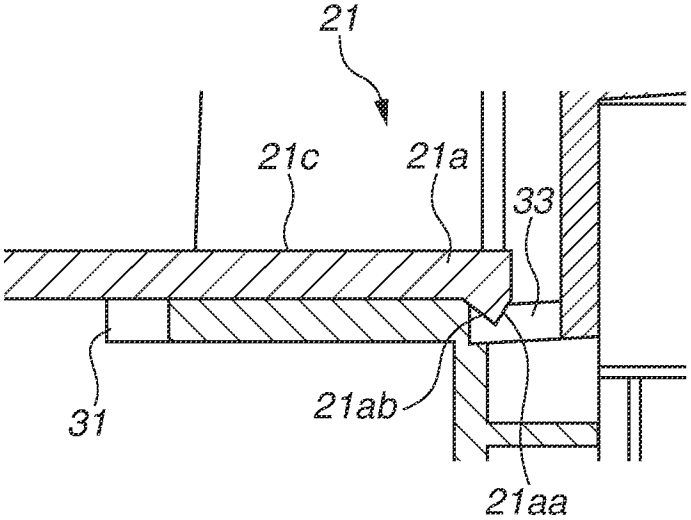
Figure 7B:
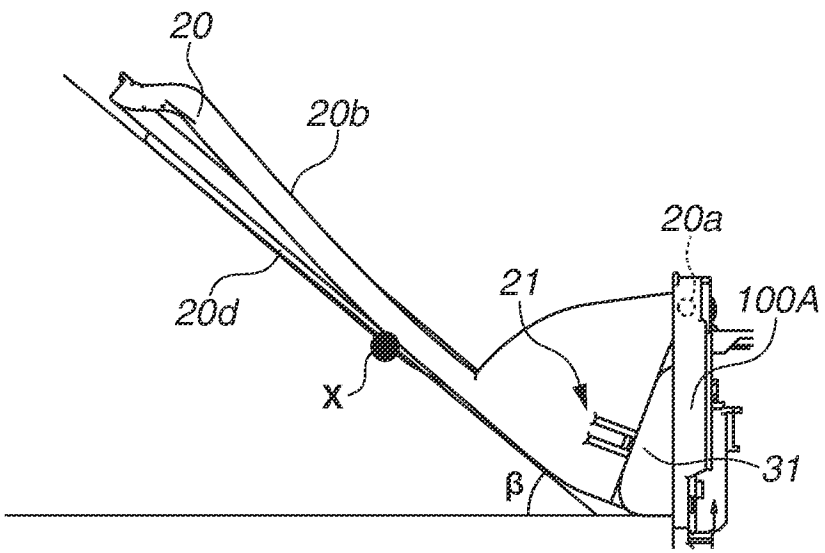
FIGS. 7A and 7B are diagrams illustrating an engaging state of the stack tray with the apparatus main body, according to a first exemplary embodiment.
Figure 7A:
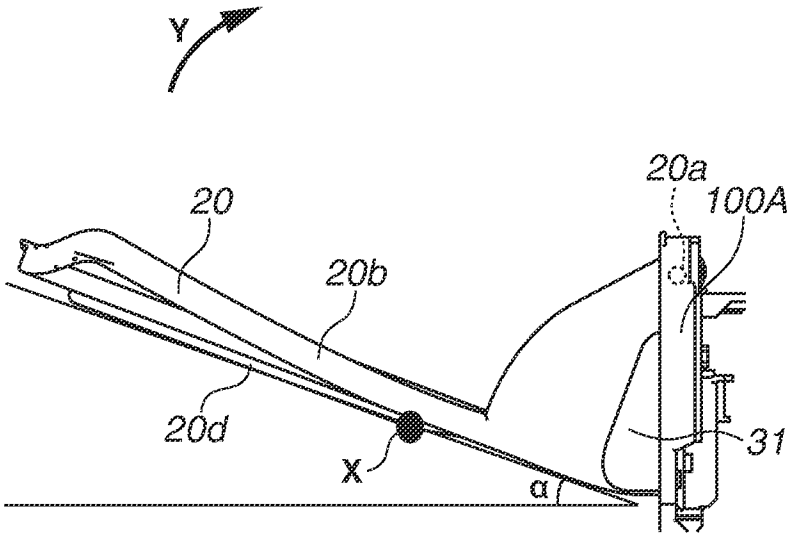

Next, an engaging state of the stack tray 20 with the apparatus main body 100A will be described. FIGS. 4A and 4B are perspective diagrams each illustrating the stack tray 20 engaging with the apparatus main body 100A. FIG. 4A illustrates the stack tray 20 in the first position, and FIG. 4B illustrates the stack tray 20 in the second position. FIG. 5 is a perspective diagram illustrating a part near an engagement portion of the apparatus main body 100A. FIGS. 6A and 6B are cross-sectional diagrams illustrating the engaging state of the stack tray 20 with the apparatus main body 100A. FIG. 6A illustrates the stack tray 20 in the first position, and FIG. 6B illustrates the stack tray 20 in the second position. FIGS. 7A and 7B are diagrams illustrating the engaging state of the stack tray 20 with the apparatus main body 100A, and show the stack tray 20 from the back side of FIGS. 4A and 4B. FIG. 7A illustrates the stack tray 20 in the first position, and FIG. 7B illustrates the stack tray 20 in the second position.

As illustrated in FIGS. 4A and 4B as well as FIGS. 7A and 7B, the stack tray 20 includes a turning center 20*a* when it is turned relative to the apparatus main body 100A, and a stack face 20*b* on which discharged sheets are stacked. The stack tray 20 further includes an upstream end portion 20*c* that is an upstream end of the stack face 20*b* in the sheet discharging direction, and an underside 20*d* opposite to the stack face 20*b*. As illustrated in FIGS. 4A and 4B, the stack tray 20 is provided with a plurality of ribs to improve the stackability of the discharged sheets. The stack tray 20 is further provided with an engagement piece 21.

As illustrated in FIG. 4B and FIG. 5, the apparatus main body 100A is provided with an engagement hole portion 33 to be engaged with the engagement piece 21. As illustrated in FIGS. 6A and 6B, the engagement piece 21 includes a protrusion 21*a* that protrudes toward the outside of the stack tray 20 on the upstream end side of the stack tray 20, and an elastic portion 21*c* provided between a pair of slits 21*b*. The elastic portion 21*c* is provided between the slits 21*b*, which is elastically deformable to change a position of the protrusion 21*a* when the stack tray 20 is turned. The engagement piece 21 is an example of an engagement portion and an example of a tray engagement piece. Further, the engagement hole portion 33 is an example of a main body engagement hole.

The stack tray 20 can be turned around the turning center 20*a* relative to the apparatus main body 100A. In other words, the stack face 20*c* of the stack tray 20 can be turned to change an angle relative to the apparatus main body 100A along with the turning of the stack tray 20.

In a case where the engagement piece 20 is in the first position that is a position for stacking S on the stack face 20*b*, the engagement piece 21 is engaged with engagement hole portion 33 as illustrated in FIG. 4*a* and FIG. 6A. In the state where the engagement piece 21 is engaged with the engagement hole portion 33, the engagement piece 21 is fit in the engagement hole portion 33 such that the stack tray 20 abuts on the apparatus main body 100A at the upstream end portion 20*c* on the upstream side in the sheet conveyance direction. The stack tray 20 is thereby held in an engaging state with the apparatus main body 100A in the first position.

Further, in a case where the stack tray 20 is in the second position that is a position in which the stack tray 20 is turned from the stack position (the first position), the engagement piece 21 of the stack tray 20 abuts on and is engaged with an engagement portion 31, as illustrated in FIG. 4B, FIG. 6B, and FIG. 7B. The protrusion 21*a* of the engagement piece 21 abuts on the engagement portion 31 such that the stack tray 20 can engage with the apparatus main body 100A in the second position. The engagement portion 31 is an example of a main body engaging portion.

In this way, in the present exemplary embodiment, the stack tray 20 can engage with the apparatus main body 100A in the plurality of positions. In other words, the stack tray 200 of the present exemplary embodiment is held while engaged with the apparatus main body 100A such that plurality of different angles can be formed with respect to the apparatus main body 10A.

In a case where the operator turns the stack tray 20 relative to the apparatus main body 100A, the stack tray 20 is raised in an arrow-Y direction in FIG. 4A to the position where the engagement piece 21 is engaged with the engagement portion 31, to turn the stack tray 20 from the first position to the second position. In contrast, in a case where the operator turns the stack tray 20 from the second position to the first position, the operator turns the stack tray 20 in the direction opposite to the arrow-Y direction to the position where the engagement piece 21 is fit in the engagement hole portion 33, while releasing the engaging state of the engagement piece 21 and the engagement portion 31. The stack tray 20 can be thereby held in the plurality of positions with respect to the apparatus main body 100A.

The protrusion 21*a* of the engagement piece 21 in the present exemplary embodiment includes a first inclined portion 21*aa*, and a second inclined portion 21*ab* at an angle gentler than the first inclined portion 21*aa* in a moving direction of the protrusion 21*a*, as illustrated in FIGS. 6A and 6B. The first inclined portion 21*aa* is engaged with the engagement portion 31 when the stack tray 20 is in the second position. The second inclined portion 21*ab* is engaged with the engagement hole portion 33 when the second tray 20 is in the first position.

The first inclined portion 21*aa* is inclined such that an angle relative to the engagement portion 31 is smaller than an angle of the second inclined portion 21*ab* relative to the edge of the engagement hole portion 33.

This configuration can inhibit turning of the stack tray 20 to the first position under the self-weight of the stack tray 20 in a case where the stack tray 20 is in the second position. In addition, when turning the stack tray 20 from the first position to the second position, the operator can easily turn the stack tray 20 in the arrow-Y direction because the second inclined portion 21*ab* and the edge portion of the engagement hole portion 33 are engaged with each other at a gentle angle.

Further, as illustrated in FIGS. 7A and 7B, the stack tray 20 and the apparatus main body 100A are engaged with each other such that an angle β relative to a horizontal plane in a case where the stack tray 20 is in the second position in FIG. 7B, is larger than an angle α relative to the horizontal plane in a case where the stack tray 20 is in the first position in FIG. 7A.

Here, each of the angles α and β is an angle formed between the underside 20*d* of the stack tray 20 and the horizontal plane. To be more specific, this is an angle formed between a flat surface and the horizontal plane at a predetermined position X of the underside 20*d*. In a case where the underside 20*d* of the stack tray 20 has the flat surface, the angles α and β are angles formed between the flat surface at the predetermined position X of the underside 20*d* and the horizontal plane. In a case where the underside 20*d* has a curved surface, the angles α and β are angles formed between a tangent line with respect to the predetermined position X of the underside 20*d* and the horizontal plane.

In the present embodiment, the stack tray 20 in the first position that is the stack position, is engaged with the apparatus main body 100A such that the angle α is 20 degrees to 30 degrees. The stack tray 20 is thus inclined relative to the apparatus main body 100A in the first position such that the stackability of the sheets discharged onto the stack face 20*b* can be improved. This is because the stack face 20*b* is inclined to some extent, so that the sheets discharged onto the stack face 20*b* move to the apparatus main body 100A side under self-weight, and the discharged sheets are aligned on the upstream side of the discharging direction of the stack tray 20. In a configuration in which the stack face 20*b* is inclined relative to the horizontal plane at an angle of one degree or more, the stackability can be improved as compared with a configuration in which the stack face 20*b* is parallel with the horizontal plane. Therefore, the angle α does not need to be limited to the above-described range of the angle. For example, the angle α may be in a range of 5 degrees or more and 30 degrees or less.

In contrast, the angle β relative to the horizontal plane of the stack tray 20 in the second position in the present exemplary embodiment is about 60 degrees.

Thus, the operator can easily make access to the space opened when the opening/closing member 11 is in the open state when the operator removes the sheet in the conveyance path of the reverse conveyance unit 180. In other words, making access to the reverse conveyance unit 180 becomes easy even if the stack tray 20 is provided above the reverse conveyance unit 180. Therefore, the workability in removing the sheet in the reverse conveyance unit 180 can be improved.

The angle β in the case where the stack tray 20 is in the second position is desirably in a range of 60 degrees or more and less than 90 degrees. When the angle β is 60 degrees or more, the visibility of the space is improved which is opened by turning the opening/closing member 11 provided below the stack tray 20 in the vertical direction. The angle β only has to be larger than the angle α, and may be 35 degrees or more and less than 90 degrees. Also in such a configuration, the visibility of the space opened by turning the stack tray 20 to the second position can be improved, as compared with a case where the space opened by turning the opening/closing member 11 is covered by the stack tray 20 in the first position.

In the present exemplary embodiment, the angle formed between the underside 20*d* of the stack tray 20 and the horizontal plane is defined as the angles α and β. However, an angle formed between the stack face 20*b* and the horizontal plane may be defined as the angles α and β. In this case, an angle formed between a plane at a predetermined position of the stack face 20*b* and the horizontal plane may be defined as the angles α and β. Here, the flat surface of the stack face 20*b* may be a plane provided between the plurality of ribs, or a plane formed on a rib or the ridge line of a rib may be defined as the plane. Further, in a case where the stack face 20*b* is a curved surface, an angle formed between the tangent line at a predetermined position of the curved surface and the horizontal plane is defined as the angles α and β.

Also in such a configuration, it is easy to make access to the space opened when the opening/closing member 11 is in the open state in a case where the operator removes the sheet in the conveyance path of the reverse conveyance unit 180. In other words, making access to the reverse conveyance unit 180 is easy even if the stack tray 20 is provided above the reverse conveyance unit 180. Therefore, the workability in removing the sheet in the reverse conveyance unit 180 can be improved.

A second exemplary embodiment will be described below. In the first exemplary embodiment, the engagement piece 21 is provided in the stack tray 20, and the engagement hole portion 33 is provided in the apparatus main body 100A. In contrast, in the present exemplary embodiment, an engagement piece 32 is provided in the apparatus main body 100A, and an engagement hole portion 22 is provided in the stack tray 20.

Figure 8B:
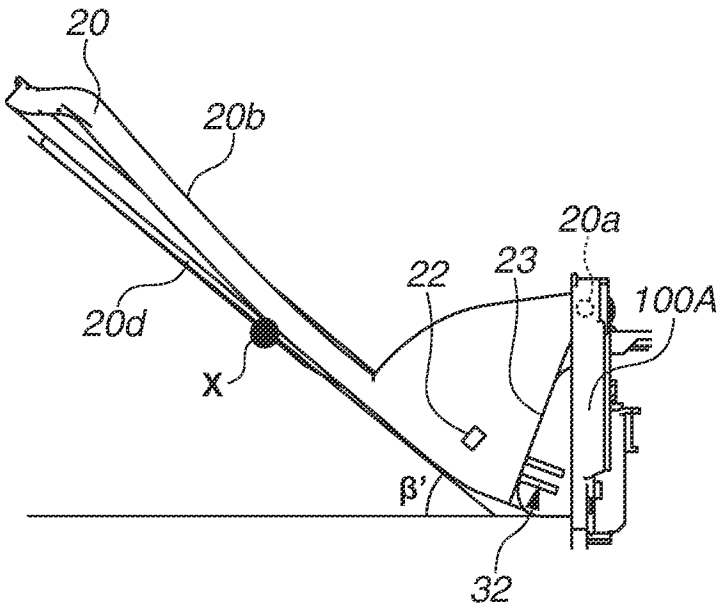
FIGS. 8A and 8B are diagrams each illustrating an engaging state of the stack tray with the apparatus main body, according to a second exemplary embodiment.
Figure 8A:
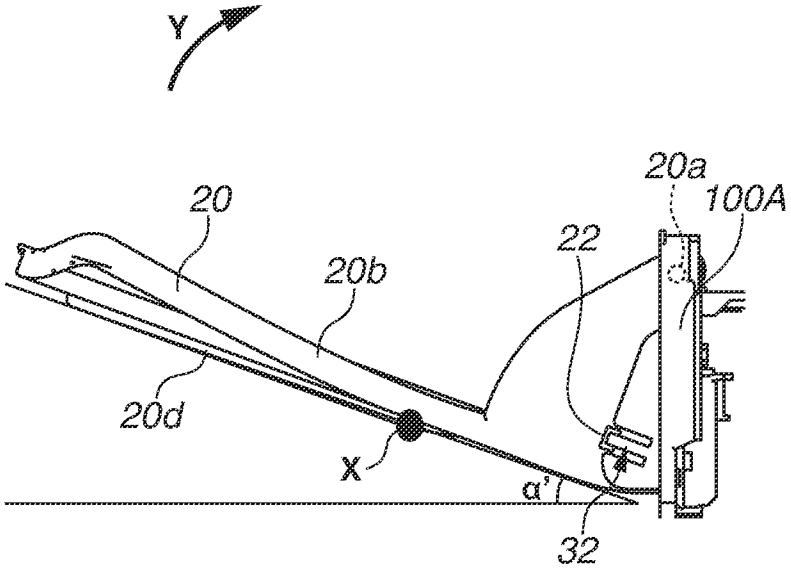

FIGS. 8A and 8B are diagrams illustrating an engaging state of the stack tray 20 with the apparatus main body 100A according to the second exemplary embodiment. FIGS. 8A and 8B illustrate the stack tray 20 as viewed from the back side of FIGS. 4A and 4B. FIG. 8A illustrates the stack tray 20 in the first position, and FIG. 8B illustrates the stack tray 20 in the second position.

In FIGS. 8A and 8B, the engagement hole portion 22 provided in the stack tray 20 and the engagement piece 32 of the apparatus main body 100A are engaged with each other in the state where the stack tray 20 is in the first position. On the other hand, an engagement portion 23 provided in the stack tray 20 and the engagement piece 32 of the apparatus main body 100A are engaged with each other in the state where the stack tray 20 is in the second position. Therefore, the stack tray 20 is held relative to the apparatus main body 100A while engaged with the apparatus main body 100A in each of the first position and the second position.

Further, as illustrated in FIGS. 8A and 8B, even in a case where the engagement piece 32 is provided in the apparatus main body 100A and the engagement hole portion 22 is provided in the stack tray 20, the stack tray 20 and the apparatus main body 100A are engaged with each other such that an angle α' of the stack tray 20 in the first position relative to the horizontal plane, is smaller than an angle β' of the stack tray 20 in the second position relative to the horizontal plane. The engagement hole portion 22 is an example of an engagement portion, and is an example of a tray engagement hole. The engagement portion 23 is an example of a tray engaged portion. The engagement piece 32 is an example of a main body engagement piece.

Thus, the operator can easily make access to the space opened when the opening/closing member 11 is in the open state in a case where the operator removes a sheet in the conveyance path of the reverse conveyance unit 180. In other words, making access to the reverse conveyance unit 180 is easy even if the stack tray 20 is provided above the reverse conveyance unit 180. Therefore, the workability in removing the sheet in the reverse conveyance unit 180 can be improved.

Other Exemplary Embodiments

In the above-described exemplary embodiments, the stack tray 20 abuts on the apparatus main body 100A at the upstream end portion 20*c* on the upstream side in a sheet conveyance direction such that the state where the stack tray 20 is engaged with the apparatus main body 100A in the first position is maintained. However, the engaging state may also be maintained by causing other portion to abut on the apparatus main body 100A.

Further, in the above-described exemplary embodiments, the engagement portion 31 is integrated with the apparatus main body 100A, and the stack tray 20 is provided in the apparatus main body 100A beforehand. However, the stack tray 20 may be configured to be attachable to the apparatus main body 100A as an option. In this case, the engagement portion 31 of the apparatus main body 100A to engage with the stack tray 20 may also be attachable to the apparatus main body 100A as an option.

In the above-described exemplary embodiments, the pair of first reverse conveyance rollers 181 and the pair of second reverse conveyance rollers 182 are provided in the apparatus main body 100A. However, one of the pairs of rollers may be provided in the opening/closing member 11. In such a configuration, since the pairs of rollers are separated, it is easy to remove a sheet stopped while being conveyed, even in a state where the sheet is pinched by the pair of first reverse conveyance rollers 181 and the pair of second reverse conveyance rollers 182.

Further, in the above-described exemplary embodiments, the turning center of the opening/closing member 11 extends in a horizontal direction on the lower side in the vertical direction. However, a turning center extending in the vertical direction may also be provided on the rear face side of the apparatus main body 100A. Also in such a configuration, the space opened by turning the opening/closing member 11 can be easily viewed by changing the angle and the position of the stack tray 20.

Further, in the above-described exemplary embodiments, the opening/closing member 11 that opens the reverse conveyance unit 180 is provided. However, the opening/closing member 11 may be provided at a position corresponding to other conveyance paths, if a conveyance unit is provided below the stack tray 20 in the vertical direction, and if the conveyance path within the apparatus main body 100A can be opened. For example, the conveyance path for conveying a sheet to the fixing unit 150 may be opened by turning the opening/closing member 11. Even in such a configuration provided with the stack tray 20 according to the present exemplary embodiments, the space opened by turning the opening/closing member 11 can be easily viewed in removing a sheet in the conveyance path.

Further, in the above-described exemplary embodiments, the opening/closing member 11 can engage with the apparatus main body 100A, in the first position and the second position. However, a third position of a larger angle relative to the horizontal plane than the second position may be provided, and the opening/closing member 11 may engage with the apparatus main body 100A in the plurality of positions. In addition, the angle relative to the apparatus main body 100A may be configured to be changeable by using a free stop mechanism for stopping the turning of the opening/closing member 11 at an arbitrary position relative to the apparatus main body 100A.

According to the exemplary embodiments of the present disclosure, it is possible to inhibit deterioration in workability in removing a sheet in the conveyance path even if the stack tray is disposed above the reverse conveyance path in the vertical direction.

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may include one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random access memory (RAM), a read-only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2019-090269, filed May 11, 2019, which is hereby incorporated by reference herein in its entirety.

What is claimed is:

1. An image forming apparatus comprising:

an image forming unit configured to form an image on a sheet;

an apparatus main body containing the image forming unit;

a reader disposed above the apparatus main body in a vertical direction and configured to read an image on a sheet;

a first conveyance unit configured to convey a sheet to the image forming unit;

a main stack tray disposed between the reader and the apparatus main body in the vertical direction, and configured to receive a sheet discharged by the first conveyance unit;

a second conveyance unit configured to reverse a sheet conveyed by the first conveyance unit and convey the sheet toward a reverse conveyance path for conveying the sheet to the image forming unit to form an image on a second side of the sheet opposite to the first side of the sheet;

an opening/closing member configured to open and close relative to the apparatus main body and, in a case where the opening/closing member is in an open state relative to the apparatus main body, allow making access to the reverse conveyance path;

a sub stack tray disposed above the opening/closing member in the vertical direction and including a stack surface on which sheets are stacked, wherein the sub stack tray is configured to be turned between a first position for stacking sheets on the stack surface, and a second position with an angle formed between an underside opposite to the stack surface and a horizontal plane that is larger than an angle of the first position; and a switching unit configured to switch a conveyance path so that a sheet conveyed by the second conveyance unit is discharged to the sub stack tray disposed at the first position and the second position, wherein the sub stack tray includes an engagement portion to engage with the apparatus main body in the second position.

2. The image forming apparatus according to claim 1, wherein, in a case where the sub stack tray is in the second position, an angle formed between the stack surface and the horizontal plane is larger than an angle formed between the stack surface and the horizontal plane in a case where the sub stack tray is in the first position.

3. The image forming apparatus according to claim 1, wherein, when the sub stack tray is viewed from above and in a case where the opening/closing member is in the open state, the first position is a position where the main stack tray covers a space formed between the opening/closing member and the apparatus main body.

4. The image forming apparatus according to claim 1, wherein the engagement portion is a tray engagement piece including a protrusion, and wherein the apparatus main body includes a main body engagement hole to engage with the protrusion in a state where the main stack tray is in the first position, and a main body portion to be engaged with the protrusion in a state where the sub stack tray is in the second position.

5. The image forming apparatus according to claim 1, wherein the engagement portion is a tray engagement hole, wherein the apparatus main body includes a main body engagement piece to engage with the tray engagement hole in a state where the main stack tray is in the first position, and wherein the main stack tray includes a tray portion to be engaged with the main body engagement piece in a state where the sub stack tray is in the second position.

* * * * *